United States Patent [19]

Duke

[11] 4,164,980

[45] Aug. 21, 1979

[54] WELL CEMENTING METHOD AND APPARATUS

[76] Inventor: John A. Duke, 418 Pamela St., Baytown, Tex. 77521

[21] Appl. No.: 930,138

[22] Filed: Aug. 2, 1978

[51] Int. Cl.[2] ..... E21B 33/05; E21B 33/16

[52] U.S. Cl. ..... 166/291; 166/70; 166/155

[58] Field of Search ..... 166/291, 285, 153–156, 166/70

[56] References Cited

U.S. PATENT DOCUMENTS

| | | | |
|---|---|---|---|
| 1,490,143 | 4/1924 | Taber | 166/70 |
| 2,253,537 | 8/1941 | Scaramucci | 166/155 |
| 2,870,842 | 1/1959 | Hall | 166/70 |
| 3,087,551 | 4/1963 | Keruer | 166/155 |
| 3,364,996 | 1/1968 | Brown | 166/156 |
| 3,635,288 | 1/1972 | Lebourg | 166/156 |
| 3,926,253 | 12/1975 | Duke | 166/88 |
| 4,047,566 | 9/1977 | Duke | 166/285 |

*Primary Examiner*—James A. Leppink

*Attorney, Agent, or Firm*—Pravel, Gambrell, Hewitt, Kirk, Kimball & Dodge

[57] ABSTRACT

A new and improved apparatus and method for cementing casings in wells that is particularly advantageous for use in subsea wells. The cementing plug apparatus contains the cementing plugs which are released by a predetermined manipulation of the support string for the apparatus. Inadvertent or premature release of the cementing plug is prevented by a telescoping tubular stinger member which protects the cementing plugs from circulation flow.

6 Claims, 5 Drawing Figures

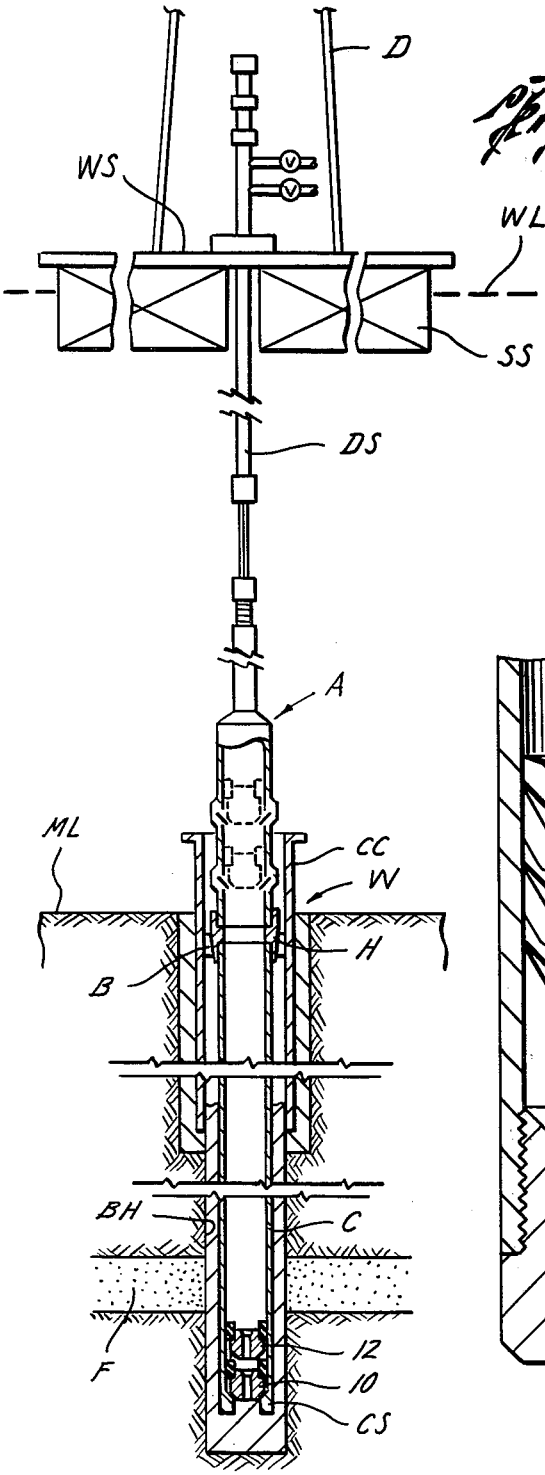
Fig. 1
Fig. 3
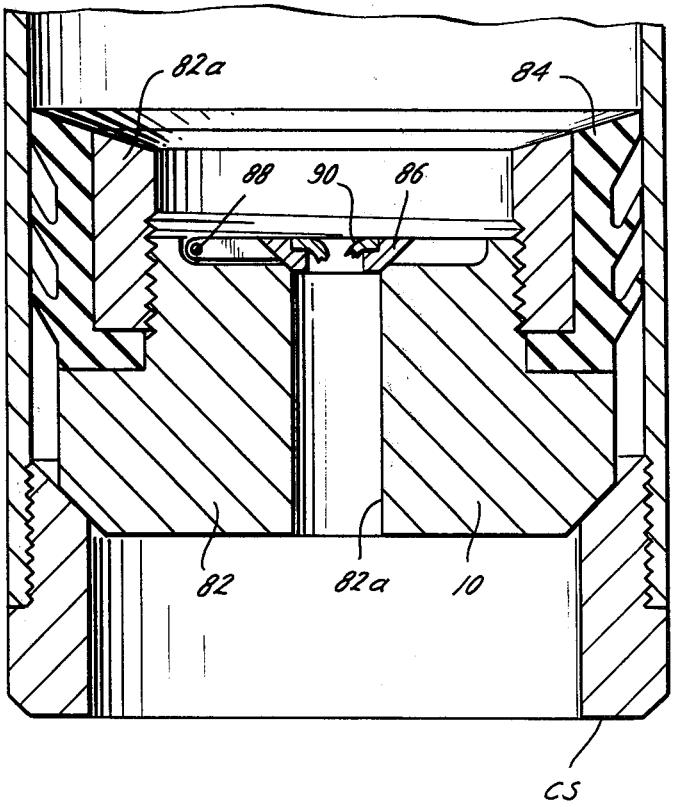

WELL CEMENTING METHOD AND APPARATUS

DESCRIPTION

1. Technical Field

This application relates to a well cementing method and apparatus that is particularly well suited to subsea wells. The apparatus provides positive control of the release of the cementing plugs from a remote location when desired.

2. Background Art

In U.S. Pat. No. 3,926,253, I disclosed a well conduit cementing Adapter Tool in which the cementing plug was positively secured against inadvertent movement.

However, it was necessary for the operator to have access to the tool housing to effect release of the cementing plugs. In U.S. Pat. No. 4,047,566 I disclosed an improvement of my earlier patent that had remote controlled plug release feature that is particularly useful in cementing subsea wells. However, as both circulation and cement flow passed through an opening in the cementing plugs and there was a possibility that either or both cementing plugs could release prematurely by inadvertent pressure buildup across a plug. Furthermore, solids in the circulating fluid could settle out on the plugs and subsequently interfere with their operation.

Positive control of the release of the cementing plugs is essential to proper well cementing. While it is possible to correct some well cementing defect rather than abandoning the well, it is expensive to do and the problem may never be fully cured. Many of the problems involved in cementing of wells are addressed in my two earlier patents to which specific reference is again made for their total incorporation herein for any and all purposes.

DISCLOSURE OF INVENTION

A new and improved well cementing method and apparatus. The apparatus includes a tubular housing having a telescoping stinger extending through the cementing plugs for isolating the plugs from circulation flow. When it is desired to release a plug during cementing operations the apparatus is manipulated by the supporting drill string to withdraw the stinger from the cementing plug. This enables a check valve on the plug to operate closed and block further flow through the cementing plug. When a sufficient pressure differential across the plug is achieved, the holding means for the plug is overcome and the cementing plug is released to operate in the usual manner.

BRIEF DESCRIPTION OF DRAWINGS

FIG. 1 is an elevation view, partially in section of a well utilizing the present invention;

FIG. 3 is an elevation view in section of a cementing plug of the present invention.

BEST MODE FOR CARRYING OUT THE INVENTION

The well conductor cementing tool plug container or housing A of the present invention is used for cementing well conduits C in a well W having a bore hole BH extending into the earth to a hydorcarbon producing formation F. The bore hole BH may have a larger conductor casing CC disposed therein and which large conductor casing casing CC may have been cemented into the bore hole BH using the method and apparatus A of the present invention.

While the cementing tool plug container A of the present invention is not limited to offshore drilling, it is particularly well suited for use with floating drilling units such as a semi-submersible unit SS or a drill ship (not illustrated). The semi-submersible SS provides a floating work surface or rig floor WS and a derrick D above the water level WL upon which work operations are conducted for drilling and enlarging the bore hole BH in the usual manner as well as for performing cementing operations.

A key step in completing any well, is in the cementing of the well casing C in the bore hole BH. It is important to avoid the formation of voids or channels in the cement which could serve as flow passages about the casing C after the cement has set. Also, after the hardening of the cement slurry the casing C may be perforated to enable the hydrocarbons to flow from the producing formation F into the well conductor C. It is also understood that the casing C may not be perforated and that one or more smaller casings can be run within the casing C and cemented in place without departing from the scope of the present invention. A typical casing program for a subsea well is disclosed in previously mentioned U.S. Pat. No. 4,047,566.

Located at the bottom of the casing C to be cemented is the cementing shoe CS which serves as a retainer for the cementing plugs 10 and 12, as is illustrated in FIG. 1. This is, of course, the location of the plugs 10 and 12 after the cementing slurry is forced from the casing into the bore hole BH to occupy the annular area formed about the casing C. There the cement slurry hardens for securing the casing C in the well.

The casing C is preferably provided with a support or hanger H which is adapted to be received in the support head or bowl B carried by the outer casing CC. The bowl B and hanger H serve to support the casing C in the bore hole BH in the usual manner. While the bowl B and hanger H are illustrated as being adjacent the mud line ML, it is understood that they may be located substantially below the mud line ML.

Figure 2A:
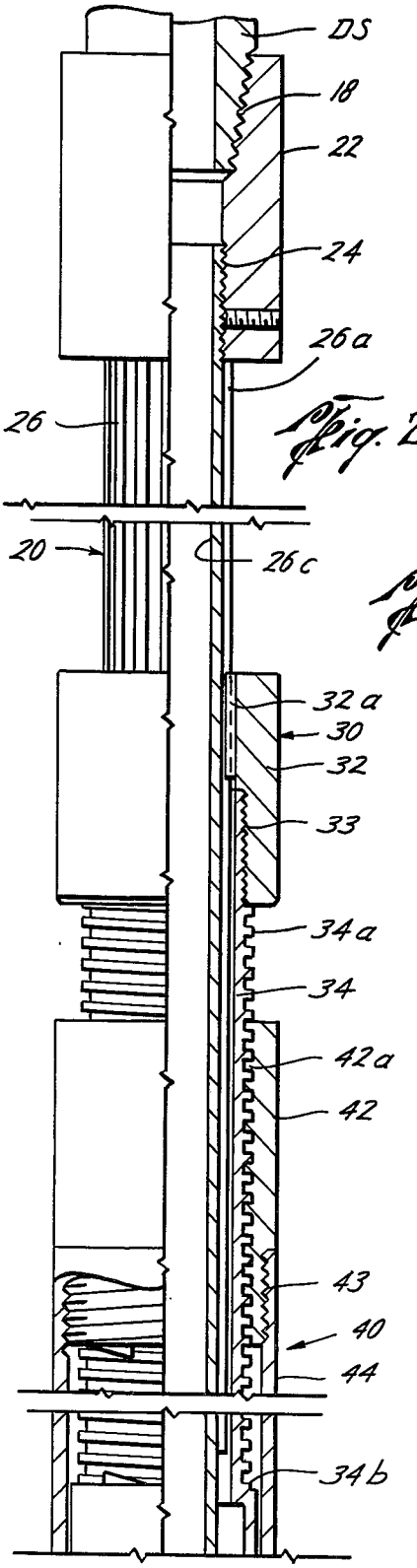
FIGS. 2A, 2B and 2C are views, in section, of the apparatus of the present invention.
Figure 2B:
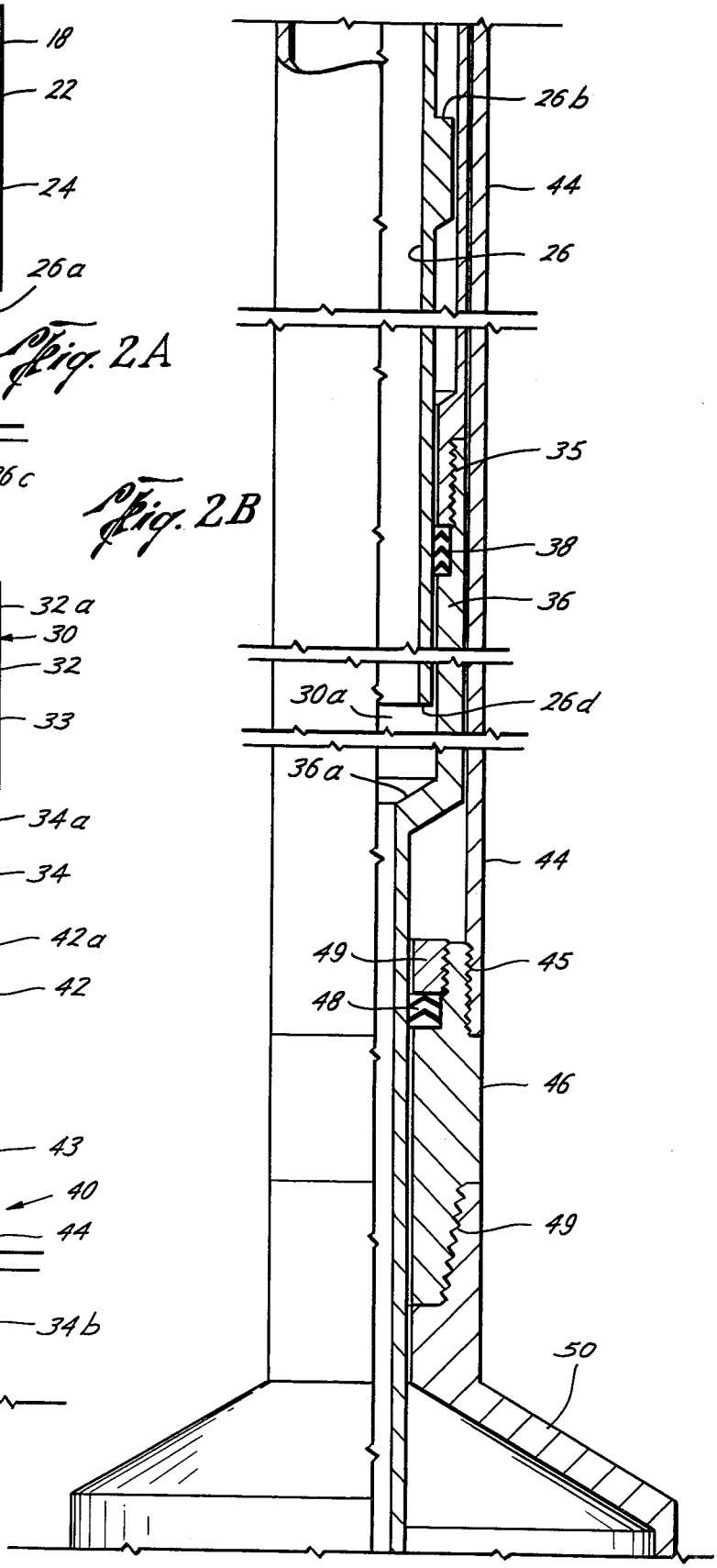
Figure 2C:
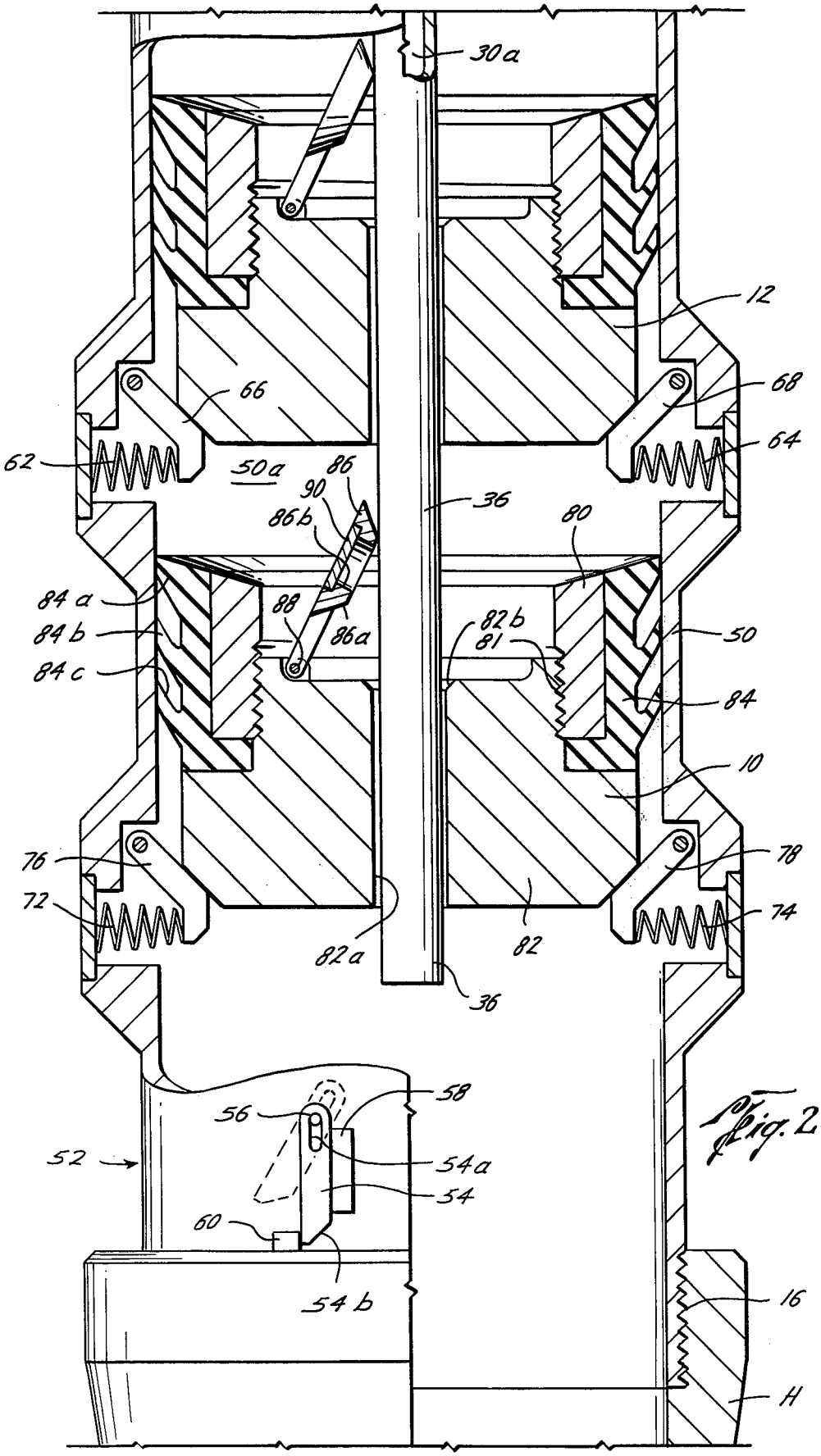

Preferably, the hanger H is connected at its upper end with the cementing plug housing A by threaded engagement at 16 (FIG. 2C). The upper end of the cementing plug housing A is secured to the drill string DS by threads 18 in the usual manner. The drill string DS is used to support and operably manipulate the cementing plug housing A from the derrick D mounted on the vessel SS as will be considered in greater detail hereinafter.

The cementing plug apparatus A is best illustrated in FIGS. 2A–2C where the alphabetical sequence indicates progression from the top to the bottom of the tool. In FIG. 2 the cementing apparatus A is in the condition it exists prior to its operation to release the cementing plugs 10 and 12.

As best illustrated in FIG. 2A, the cementing tool plug container apparatus A includes an upper wash pipe section, generally designated 20, connected to the drill string DS and which telescopically extends to a stinger section, generally designated 30, of the plug container A and which in turn is connected to the cementing plug housing section, generally designated 40. The cementing plug housing section 40 is connected to the hanger H by threads 16 in the usual manner for supporting the hanger H and casing C.

The wash pipe section 20 (FIGS. 2A and 2B) includes a tubular adapter coupling 22 which forms threaded engagement at 18 for securing the cementing plug apparatus A with the drill string DS. The adapter coupling 22 is also provided with threads 24 for mounting the downwardly extending wash pipe 26 thereon. The outer surface of the wash pipe 26 is splined at 26*a* for imparting rotation to the stinger section 30 and which spline 26*a* terminates at upwardly facing annular stop shoulder 26*b* (FIG. 2B). The wash pipe 26 is tubular having an inner surface 26*c* defining the central bore or flow passage which terminates at downwardly facing annular shoulder 26*d*.

The stinger section 30 includes a splined lock collar 32 that is secured to an intermediate thread section 34 by threaded engagement at 33 and which splined collar 32 coacts with splines 26*c* for imparting rotation to the stinger 30. The outer surface of the thread section 34 is provided with a square left-handed helical thread 34*a* which extends downwardly to an upwardly facing annular stop shoulder 34*b* formed on the outer threaded surface 34*a*. The intermediate section 34*b* extends downwardly to the lower stinger section 36 to which it is secured by threaded engagement at 35. The lower tubular stinger section 36 carries Chevron packing 38 adjacent thread 35 for continuously sealing with the wash pipe member 26 during cementing operations. The lower portion of the stinger section 36 extends downwardly through the central openings of the cementing plugs 10 and 12. The reduction in diameter of the stinger section 36 provides an upwardly facing fluid pressure responsive annular shoulder 36*a* that is exposed to the fluid in the central flow passage 30*a* of the stinger 30.

The cementing plug housing section 40 is provided adjacent its upper end with a collar 42 (FIG. 2A) having an internal square thread section 42*a* for mating with the external threads 34*a* of the threaded stinger section 34. The threaded housing collar 42 is connected to a fixed inner and outer diameter tubular portion 44 of the cementing plug housing section at threads 43. The tubular section 44 extends downwardly to connect with a housing base section 46 by threaded engagement at 45. Adjacent the threaded connection 45 is a seal 48 held by threaded retainer 49 which maintains the packing 48 in position on the housing member 46 for sealing with the wash pipe 36 and guiding its movement. The lower, larger diameter cementing plug housing section 50 is connected by threads 49 with the tubular housing base section 46 (FIG. 2B) which 50 has the thread 16 formed thereon for securing with the hanger H as previously mentioned.

The threads 16 are right-hand threads and to prevent additional make-up of the threads 16 during right-hand rotation of the drill string DS and casing C a make-up limiting lug 54 is provided. The make-up limiting lug 54 is pivotally mounted by pin 56 in slot 54*a* with the tubular housing base section 50 on its outer surface. A fixed lug 58 secured to the outer surface of the housing section 50 blocks movement of the latching lug 54 when it engages the lug 60 secured on the hanger H for preventing further make-up. The slotted pivotal connection of the make-up limiting member 54 enables both make-up of thread 16 by elevating lug 54 during right-hand make-up rotation and the movement over the lug 60 of the hanger when left-hand rotation is imparted through the drill string DS to the housing section 50 for breaking out the thread 16 as is illustrated in phantom in FIG. 2C. The tapered portion 54*b* of the latch 54 will assist the movement of the latch 54 moving over the lug 60 during such rotation.

The lock or stop 54 prevents the tool from making up tighter during rotation while discharging plugs or while rotation of the casing string, therefore guaranteeing a backoff at that point at job completion.

Secured in the bore 50*a* of the housing section 50 are the cementing plugs 10 and 12. The cementing plug 12 is secured in position by the urgings of springs 62 and 64 on inwardly projecting pivoted retainers 66 and 68, respectively. For the plug 12 to move downwardly, it is necessary that the urging of the springs 62 and 64 be overcome for moving the retainer lugs 66 and 68 pivotally downwardly to enable passage of the cementing plug 12. The biasing of springs 72 and 74 on pivoted lugs 76 and 78, respectively, serve to hold the lower cementing plug 10 in position in a similar manner.

The cementing plug 10 is of two piece construction being formed by the seal securing ring 80 which is secured with a central or body portion 82 by threaded engagement at 81. The removable seal retainer 80 retains the resilient wiper element 84 with the cementing plug 10 and enables the wiper element 84 to be easily changed if it becomes damaged during shipment as well as for ease of assembly. The wiper element is provided with upwardly facing swab-like cups 84*a*, 84*b* and 84*c* in the usual manner.

The plug body 82 is provided with a central opening 82*a* through which the stinger 36 extends. At the upper end of the central opening 82*a* is formed an annular seat 82*b*. Pivotally secured to the upper portion of the body 82 is a pivoting flapper element 86 which is pivotally attached to the body by pin 88. The flapper element 86 is provided with an annular seating shoulder 86*a* which is adapted to engage the annular seal shoulder 82*b* of the body when the flapper 82 is released and moved to a lower position. Once the flapper element 86 is moved to the sealing position a differential pressure can be built up across the plug body 82 for effecting its release. The flapper element is provided with a central opening 86*b* that is closed by a shearable element 90. After the plug 10 is released and moved to the casing shoe CS sufficient pressure can be built up across the plug 10 to effect rupture of the element 90 to enable the cement slurry located above the plug 10 to flow through the opening 82*a* and into the bore hole BH.

The plug 12 is similar in construction to plug 10 and need not be described in detail. It is noted, however, that the flapper element of the plug 12 will not need a shearable element 90 and may be solid.

USE AND OPERATION

In the use and operation of the present invention the casing C is connected on the working surface WS and lowered on into the well bore hole BH using derrick D. At the appropriate location the hanger H is connected into the casing C. Thereafter the make-up limiting lug 54 is elevated and the thread connection 16 is made up between the hanger H and the housing 50.

The cementing tool plug container apparatus A is in the condition illustrated in FIGS. 2A, 2B and 2C. The plugs 10 and 12 are secured within the apparatus A by the appropriate pivoted retainer lugs and the wash pipe 36 extends through the central opening of both plugs 10 and 12. The drill string DS is connected to the upper end of the apparatus A by threaded engagement at 18 and sufficient drill pipe is added to the drill string DS to lower the casing C to the position illustrated in FIG. 1. During this time circulation of drilling fluid may be maintained down the drill string and through the bore 26*c* of the wash pipe 26 and through the bore 38 of the stinger 38. The stinger 36 provides a flow passage through the plugs 10 and 12 and therefore they are essentially insulated from circulation flow which could inadvertently effect their release.

It should be noted that the pressure of the circulating fluid 36 acts on the shoulder 36*a* to provide a downward force on the apparatus A which is transmitted to the lower housing section 50 and the hanger H and casing C. By increasing the circulation pressure the magnitude of the downward force can be increased in a manner similar to that of a bumper sub. In fact, the present tool could use a standard bumper sub and the spline lock member 32 could be connected directly to the drill string DS having such a bumper sub for providing the desired downward force to maintain or move the hanger H into the bowl B as well as the axial motion compensator as the apparatus A is manipulated to release the cementing plugs 10 and 12.

As soon as sufficient cement has been pumped into the drill string DS for filling the drilling string and the cementing apparatus A, it is desirable to release the bottom plug 10. This is accomplished by manipulating the drill string DS. The weight of the casing C is taken off the cementing apparatus A and drill string DS by resting the hanger H in the bowl B. With the weight of the casing C removed from the cementing apparatus A, right-hand rotation is imparted to the drill string DS which is transmitted through the coacting splines 26*a* and 32*a* for rotating the stinger 40 to move telescopically outwardly from the housing 50 by the left-hand threads 34*a* and 42*a*. As the extension 36 of the stinger moves upwardly from the opening 82*a* of the plug 10 the flapper element 86 is free to fall by the weight of gravity and seat on the upwardly facing annular seat 82*b* of the plug. Continued circulation of the cement slurry at this point will build up a pressure differential across the cementing plug 10 for overcoming the urging of springs 72 and 74 for urging the pivoted keeper or retainer latches 76 and 78, respectively, downwardly to enable the cementing plug to move downwardly from the apparatus A into the casing C.

As the last of the circulating cement slurry is approximately at the level of the plug 12, it becomes desirable to release the upper plug 12. This is also done by rotating the drill string DS to the right for effecting upward movement of the wash pipe 36 through the plug 12. This enables the associated flapper to close and thereby create a pressure differential across the plug 12 for moving it downwardly by overcoming the urging of springs 62 and 64.

With the cement slurry essentially trapped in the casing C between the plugs 10 and 12 it becomes necessary to force the cement from the casing C between the plugs 10 and 12 into the bore hole BH. This is done when the lower plug 10 reaches the casing shoe CS and further movement is prevented. At that time the pressure must be built up sufficiently to rupture the element 92 of the flapper 86 for enabling the cement slurry to flow from the casing C into the bore hole BH for filling the annulus about the casing C. Continued circulation will move the upper cementing plug 12 downward until it rests upon the lower plug 10 at the bottom of the casing C.

Although primarily designed for subsea operations, particularly drill ships and semi-submersibles that are working in rough waters, the tool A can also be used on land rigs and offshore rigs that discharge cementing plugs from above the rig floor. To discharge plugs from above the rig floor WS, the casing spider or slips would have to be set so that the rig operator could slack down into the range of free travel of the slack joint portion of the tool, therefore making it easy to turn the top section of the tool A that elevates the bottom of the stinger 30 above the plugs 10 and 12.

One purpose of the spline joint (which could be hex or corrugated) is to allow the driller to set the subsea hanger H down into the subsea head B. After setting down in the head B the driller can slack off more into the range of travel of the slack joint. This allows the threaded section, that elevates the work pipe stinger 30 to be rotated with a minimum of weight or strain on the square threads 34*a* and 42*a*. If the wave height is greater than the movement range of the spline joint, additional bumper jars may be used to provide a greater range of travel as well as a longer stroke to jar with.

After discharging the second or last plug 12 the driller may rotate the casing string C while pumping down since the left handed threads have reached their rotational limit. If the square threads 34*a* and 42*a* are right handed threads each plug is discharged by rotating to the left instead of the right a certain number of times. An equal amount of turns back to the right will enable casing C rotation while pumping cement into the well W.

The foregoing disclosure and description of the invention are illustrative and explanatory thereof, and various changes in the size, shape and materials as well as in the details of the illustrated construction may be made without departing from the spirit of the invention.

I claim:

1. A method of cementing a well conduit in a well bore comprising the steps of:

forming a well conduit to be cemented in the well bore at a work surface disposed above the well bore;

mounting a hanger with the well conduit for supporting the well conduit in the well; mounting a cementing plug container above the well conduit;

connecting the cementing plug container with a tubular string for supporting the well conduit and the cementing plug container from the work surface;

flowing a cement slurry through the tubular string to the cementing plug container;

manipulating the tubular string to operate the cementing plug container to release a first cementing plug;

moving the first cementing plug downwardly through the well conduit;

manipulating the tubular string to operate the cementing plug container to release a second cementing plug;

moving the second cementing plug downwardly through the well conduit through the well conduit into engagement with the first cementing plug for internally clearing the well conduit of cement slurry while forcing the cement slurry into the well bore.

2. The method as set forth in claim 1, including the step of:

supporting the well conduit with a hanger on a hanger support after the second cementing plug engages the first cementing plug and prior to the setting of the cement.

3. The method as set forth in claim 1, including the step of:

supporting the first cementing plug at the bottom of the well conduit to enable passage of the cement into the well.

4. Well cementing plug apparatus, including:

a tubular body forming a central passageway;

means for connecting said tubular body with a well conductor to be cemented in a bore hole;

means for connecting said tubular body with a tubular support for supporting said tubular body, a plurality of cementing plugs releasably disposed in said central passageway, each of said cementing plugs having a flow passage formed therethrough and a movable closure element for closing each said flow passage; and means movably mounted with said tubular body for extending through said flow passage of each said cementing plug to form a circulation flow passage past said cementing plugs, said means being withdrawable from said central passageway to enable said movable closure element to close said flow passage through each said cementing plug in response to manipulation of the tubular support.

5. The apparatus as recited in claim 4, wherein:

said means for extending through said central passageway including a stinger member operably connected with said means for connecting said tubular body with a tubular support, said stinger member threadedly connected with said tubular body for relative telescoping movement upon rotation of the tubular support.

6. The apparatus as recited in claim 5, wherein:

said tubular support transmits right-hand rotation to the stinger member for effecting its movement.

* * * * *